US011118579B2

(12) United States Patent
Jeon et al.

(10) Patent No.: US 11,118,579 B2
(45) Date of Patent: Sep. 14, 2021

(54) LINEAR COMPRESSOR

(71) Applicant: LG Electronics Inc., Seoul (KR)

(72) Inventors: Wooju Jeon, Seoul (KR); Donghan Kim, Seoul (KR); Kichul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 154 days.

(21) Appl. No.: 16/502,910

(22) Filed: Jul. 3, 2019

(65) Prior Publication Data

US 2020/0011318 A1 Jan. 9, 2020

(30) Foreign Application Priority Data

Jul. 3, 2018 (KR) ..... 10-2018-0077184

(51) Int. Cl.
*F04B 39/16* (2006.01)
*F04B 35/04* (2006.01)

(52) U.S. Cl.
CPC ..... *F04B 39/16* (2013.01); *F04B 35/04* (2013.01)

(58) Field of Classification Search
CPC ..... F04B 35/04; F04B 35/045; F04B 39/122; F04B 39/123; F04B 39/16
See application file for complete search history.

(56) References Cited

U.S. PATENT DOCUMENTS

| | | | | |
|---|---|---|---|---|
| 9,890,779 | B2 * | 2/2018 | Ahn | F04B 53/20 |
| 10,151,308 | B2 * | 12/2018 | Choi | F04B 39/126 |
| 10,487,814 | B2 * | 11/2019 | Lee | F04B 35/045 |
| 2009/0238701 | A1 * | 9/2009 | Giacchi | F04B 39/0292 417/321 |
| 2010/0098356 | A1 * | 4/2010 | Giacchi | F16C 32/06 384/12 |
| 2015/0078925 | A1 * | 3/2015 | Choi | F04B 53/008 417/228 |

FOREIGN PATENT DOCUMENTS

| | | |
|---|---|---|
| EP | 2848810 | 3/2015 |
| EP | 2780593 | 6/2016 |
| EP | 3242024 | 11/2017 |
| JP | H05503661 | 6/1993 |
| KR | 1020140100965 | 8/2014 |
| KR | 1020170124903 | 11/2017 |
| KR | 1020180039959 | 4/2018 |

OTHER PUBLICATIONS

Extended European Search Report in European Application No. 19175360.7, dated Aug. 23, 2019, 9 pages.

* cited by examiner

*Primary Examiner* — Patrick Hamo
(74) *Attorney, Agent, or Firm* — Fish & Richardson P.C.

(57) ABSTRACT

Provided is a linear compressor. The linear compressor includes a filter bracket seated on a gas inflow part passing through a cylinder and a filter assembly including a filter member seated on the filter bracket.

20 Claims, 12 Drawing Sheets

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0077184 (filed on Jul. 3, 2018), which is hereby incorporated by reference in its entirety.

BACKGROUND

The present disclosure relates to a linear compressor.

In general, compressors are machines that receive power from a power generation device such as an electric motor or a turbine to compress air, a refrigerant, or various working gases, thereby increasing a pressure. Compressors are being widely used in home appliances or industrial fields.

Compressors are classified into reciprocating compressors, rotary compressors, and scroll compressors.

In such a reciprocating compressor, a compression space for compressing a working gas is defined between a piston and a cylinder. While the piston linearly reciprocates within the cylinder, a refrigerant introduced into the compression space is compressed.

Also, in such a rotary compressor, a compression space for compressing a working gas is defined between a roller that rotates eccentrically and a cylinder. While the roller eccentrically rotates along an inner wall of the cylinder, a refrigerant introduced into the compression space is compressed.

Also, in such a scroll compressor, a compression space for compressing a working gas is defined between an orbiting scroll and a fixed scroll. While the orbiting scroll rotates along the fixed scroll, a refrigerant within the compression space is compressed.

In recent years, a linear compressor, which is directly connected to a driving motor, in which piston linearly reciprocates, to improve compression efficiency without mechanical losses due to motion conversion and has a simple structure, is being widely developed.

The linear compressor suctions and compresses a refrigerant within a sealed shell while a piston linearly reciprocates within the cylinder by a linear motor and then discharges the compressed refrigerant.

The linear motor is configured to allow a permanent magnet to be disposed between an inner stator and an outer stator. The permanent magnet linearly reciprocates between the inner stator and the outer stator by electromagnetic force.

Here, the linear motor is configured to allow the magnet to be disposed between the inner stator and the outer stator. The magnet is driven to linearly reciprocate by the electromagnetic force between the magnet and the inner (or outer) stator. Also, since the magnet is driven in a state where the magnet is connected to the piston, the magnet suctions and compresses the refrigerant while linearly reciprocating within the cylinder and then discharge the compressed refrigerant.

In relation to the linear compressor having the above-described structure, the present applicant has filed a patent application (hereinafter, referred to as a prior art document).

Prior Art Document: Korean Patent Publication No. 10-2018-0039959 (Apr. 19, 2018)

In the linear compressor disclosed in the prior art document, a gas bearing technology in which a refrigerant gas is supplied in a space between a cylinder and a piston to perform a bearing function is disclosed. The refrigerant gas flows to an outer circumferential surface of the piston through a nozzle provided in the cylinder to act as a bearing in the reciprocating piston.

To improve compression efficiency of the linear compressor, it is necessary to minimize a consumed amount of refrigerant gas used as a gas bearing. To reduce the consumed amount of refrigerant gas, a diameter of the cylinder nozzle and the number of cylinder nozzles have to be reduced. However, if the diameter of the cylinder nozzle decreases, or the number of cylinder nozzles is reduced, the cylinder nozzle may be blocked to greatly affect reliability of the compressor.

That is, if the diameter of the cylinder nozzle decreases, or the number of cylinder nozzles is reduced, the cylinder nozzle may be blocked by oil or a mixture of the oil and dusts to significantly reduce a function of the gas bearing.

To solve this limitation, according to the prior art document, a thread made of a polyethylene terephthalate (PET) may be wound around a gas inflow part provided on an outer circumferential surface of the cylinder and thus used as a precipitation filter-type filter member.

However, in this case, when the filter is exposed for a long time under the operation conditions of the compressor in which a pressure and a temperature rapidly change, the tension of the filer may be reduced to significantly deteriorate the filtering performance as time elapses. When the filtering performance is significantly deteriorated, the blocking of the cylinder nozzle becomes serious due to the oil or the mixture of the oil and the dusts.

SUMMARY

Embodiments provide a linear compressor including a filter assembly that is capable of filtering foreign substances contained in a refrigerant gas while adjusting a flow rate of the refrigerant gas used as a gas bearing.

Embodiments also provide a linear compressor which is capable of preventing a nozzle from being blocked while maintaining performance of a gas bearing even though a diameter of the nozzle or the number of nozzles, through which a refrigerant gas is introduced into a cylinder, is reduced.

Embodiments also provide a linear compressor in which a filter assembly is capable of being easily installed in a cylinder and prevented from separated from the cylinder.

Embodiments also provide a linear compressor in which a filter member provided in a filter assembly is capable of being protected by a filter bracket and prevented from being separated from the filter bracket.

Embodiments also provide a linear compressor in which a filter assembly is modularized through a simple process.

Embodiments also provide a linear compressor in which force equal to or greater than piston supporting force is being secured by using a refrigerant consumption flow rate less than that of an existing linear compressor.

In one embodiment, a linear compressor includes a filter assembly installed in a gas inflow part passing through a cylinder. The filter assembly may include a filter bracket having a hole and seated on the gas inflow part and a filter member seated on the filter bracket to adjust a flow rate of a refrigerant gas used as a gas bearing and filter foreign substances contained in the refrigerant gas.

The gas inflow part may include a seat groove recessed inward from an outer circumferential surface of the cylinder in a radial direction and a through-hole passing from the seat groove to an inner circumferential surface of the cylinder, and the filter bracket may be inserted into the seat groove to easily install the filter bracket on the outside of the cylinder.

Since the filter bracket is provided in a shape that surrounds the filter member, the filter member may be strongly fixed by the filter bracket, and separation of the filter member from the filter bracket may be prevented.

The filter bracket may have a hole and include an extension part extending upward along an edge of the plate, and the filter member may be accommodated in an inner space defined by the extension part to safely protect the filter member against vibration or shaking.

The filter member may be laminated on the plate in the inner space. A portion of the refrigerant discharged from the compression space may pass through the filter member and be introduced into the through-hole of the gas inflow part through the hole of the plate. Thus, foreign substances contained in the refrigerant gas may be filtered by the filter member, and a flow rate of the refrigerant may be adjusted through the hole of the plate.

The seat groove may have a diameter D1 greater than that D2 of the through-hole, and the seat groove has a recessed depth H1 less than or equal to that H2 of the through-hole.

The filter member may be made of a metallic martial having a plurality of filter holes, and the filter bracket may be made of an engineering plastic material. Since the filter member and the filter bracket are made of materials having thermal expansion coefficients different from each other, the filter member and the filter bracket may be strongly closely attached to each other while being expanded by heat received from the refrigerant gas.

The filter bracket may further include a bent part provided by bending a portion of the extension part toward the inner space, and at least a portion of the bent part may be closely attached to the filter member to prevent the filter member from being separated from the inside of the filter bracket.

The filter assembly may further include a filter support part accommodated in the inner space and disposed between the plate and the filter member.

The filter member may be made of a porous organic material, and the filter support part may be made of a porous metallic material. A flow rate of the refrigerant gas may be adjusted by the filter member, and foreign substances contained in the refrigerant gas may be filtered by the filter member. Although the filter member is deformed to correspond to a sharp change of a pressure and a temperature, the filter member may be maintained in shape and position by the filter support part.

The filter assembly may further include a bracket cover covering an opened surface of the filter bracket, and the bracket cover may have a hole and be disposed on the filter member.

The filter bracket may include a first plate having a first hole and placed on the seat groove;

a filter member disposed on the first plate and a second plate having a second hole and disposed on the filter member.

The first plate, the filter member, and the second plate may be sequentially laminated. Here, a center of the first hole and a center of the second hole may be disposed in the same line.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
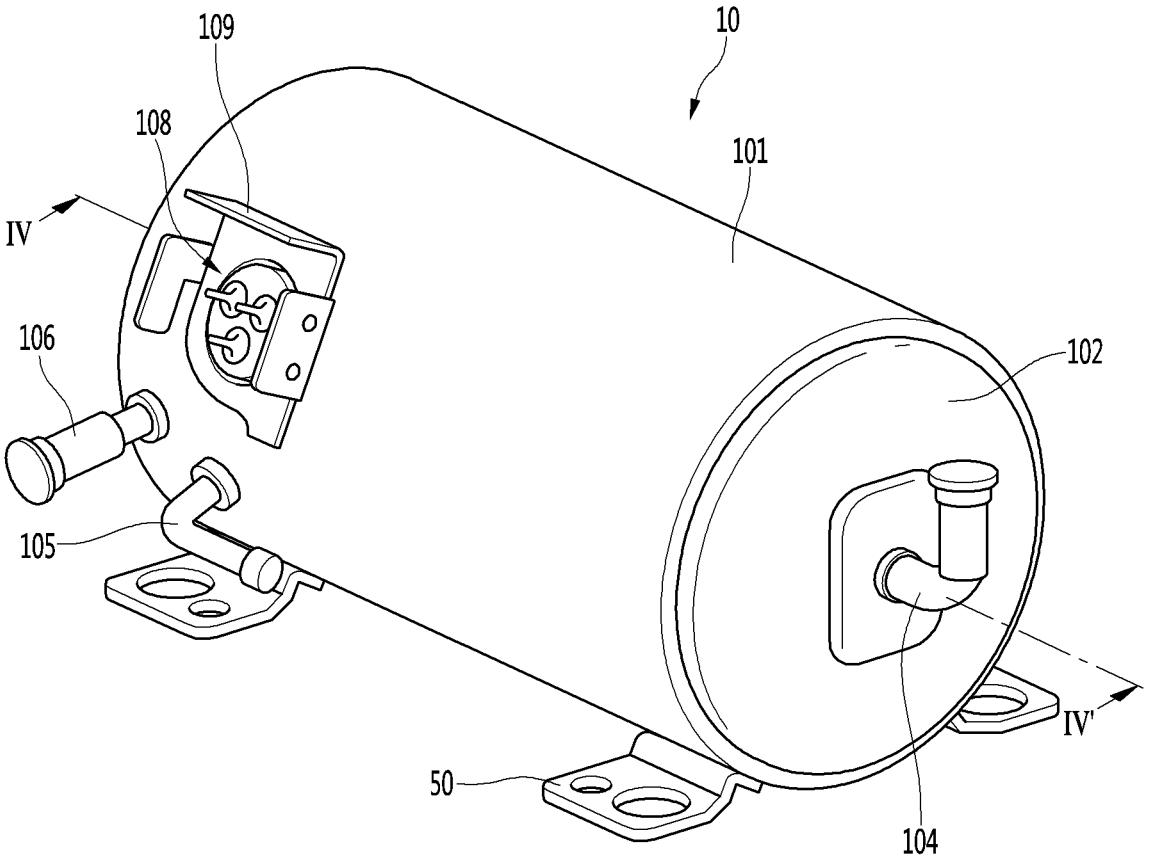
FIG. 1 is a perspective view of a linear compressor according to a first embodiment.
Figure 2:
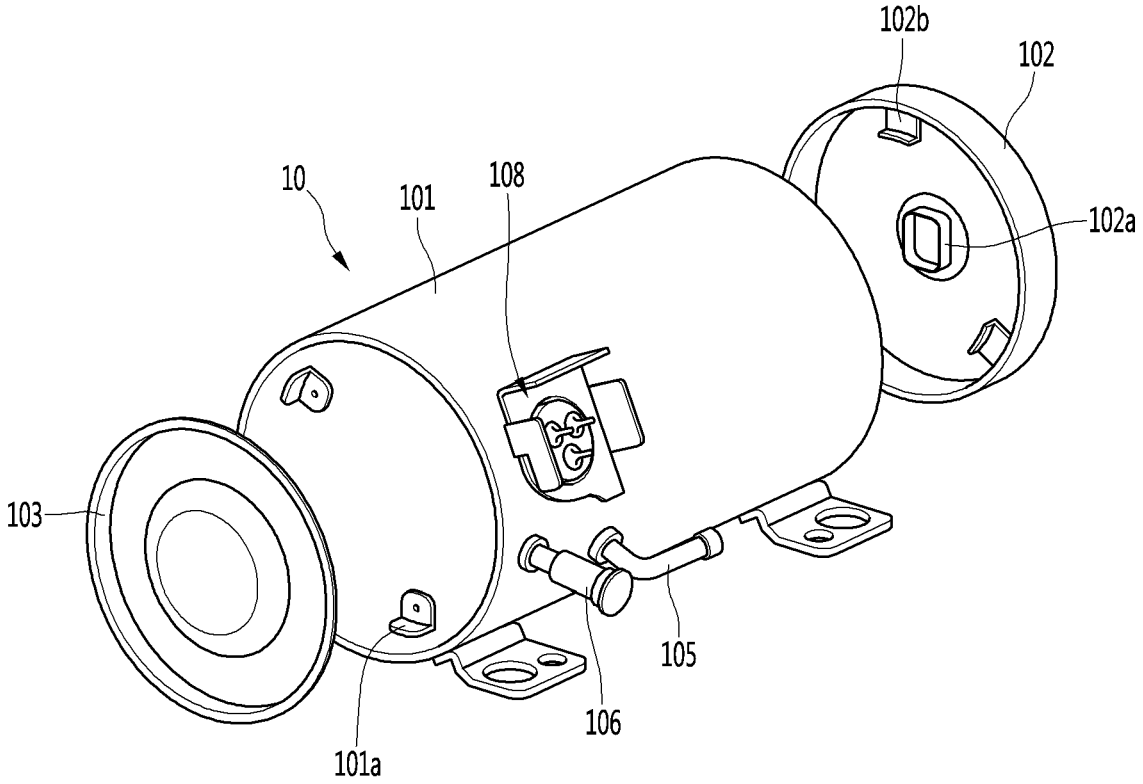
FIG. 2 is a view illustrating a state in which a shell and a shell cover are separated from each other in the linear compressor of FIG. 1.

FIG. 1 is a perspective view of a linear compressor according to a first embodiment, and FIG. 2 is a view illustrating a state in which a shell and a shell cover are separated from each other in the linear compressor of FIG. 1.

Referring to FIGS. 1 and 2, a linear compressor 10 according to a first embodiment includes a shell 101 and shell covers 102 and 103 coupled to the shell 101. In a broad sense, each of the shell covers 102 and 103 may be understood as one component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, since the linear compressor 10 has a low height, for example, when the linear compressor 10 is installed in the machine room base of the refrigerator, a machine room may be reduced in height.

A terminal 108 may be installed on an outer surface of the shell 101. The terminal 108 may be understood as a component for transferring external power to a motor assembly (see reference numeral 140 of FIG. 3) of the linear compressor 10. Particularly, the terminal 108 may be connected to a lead line of a coil (see reference numeral 141*c* of FIG. 3).

A bracket 109 is installed outside the terminal 108. The bracket 109 may include a plurality of brackets surrounding the terminal 108. The bracket 109 may protect the terminal 108 against an external impact and the like.

Both sides of the shell 101 may be opened. The shell covers 102 and 103 may be coupled to both the opened sides of the shell 101. In detail, the shell covers 102 and 103 include a first shell cover 102 coupled to one opened side of the shell 101 and a second shell cover 103 coupled to the other opened side of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. That is to say, the first and second shell covers 102 and 103 may be disposed to face each other.

The linear compressor 10 further includes a plurality of pipes 104, 105, and 106, which are provided in the shell 101 or the shell covers 102 and 103 to suction, discharge, or inject the refrigerant.

The plurality of pipes 104, 105, and 106 include a suction pipe 104 through which the refrigerant is suctioned into the linear compressor 10, a discharge pipe 105 through which the compressed refrigerant is discharged from the linear compressor 10, and a process pipe through which the refrigerant is supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position that is closer to the second shell cover 103 than the first shell cover 102.

The process pipe 106 may be coupled to an outer circumferential surface of the shell 101. A worker may inject the refrigerant into the linear compressor 10 through the process pipe 106.

The process pipe 106 may be coupled to the shell 101 at a height different from that of the discharge pipe 105 to avoid interference with the discharge pipe 105. The height is understood as a distance from the leg 50 in the vertical direction (or the radial direction). Since the discharge pipe 105 and the process pipe 106 are coupled to the outer circumferential surface of the shell 101 at the heights different from each other, work convenience may be improved.

At least a portion of the second shell cover 103 may be disposed adjacent to the inner circumferential surface of the shell 101, which corresponds to a point to which the process pipe 106 is coupled. That is to say, at least a portion of the second shell cover 103 may act as flow resistance of the refrigerant injected through the process pipe 106.

Thus, in view of a passage for the refrigerant, the passage for the refrigerant introduced through the process pipe 106 decreases in size by the second shell cover 103 when entering into the inner space of the shell 101 and then increases in size again after passing through the inner space of the shell 101. In this process, a pressure of the refrigerant may be reduced to allow the refrigerant to be vaporized. Also, in this process, an oil component contained in the refrigerant may be separated. Thus, the refrigerant from which the oil component is separated may be introduced into a piston 130 (see FIG. 3) to improve compression performance of the refrigerant. The oil component may be understood as working oil existing in a cooling system.

A cover support part 102*a* is disposed on an inner surface of the first shell cover 102. A second support device 185 that will be described later may be coupled to the cover support part 102*a*. The cover support part 102*a* and the second support device 185 may be understood as devices for supporting a main body of the linear compressor 10. Here, the main body of the linear compressor 10 represents a component provided in the shell 101. For example, the main body may include a driving part that reciprocates forward and backward and a support part supporting the driving part.

The driving part may include components such as the piston 130, a magnet 146, a support 137, and a muffler 150, which will be described later. Also, the support part may include components such as resonant springs 176*a* and 176*b*, a rear cover 170, a stator cover 149, a first support device 165, and a second support device 185, which will be described later.

A stopper 102*b* may be disposed on the inner surface of the first shell cover 102. The stopper 102*b* may be understood as a component for preventing the main body of the linear compressor 10, particularly, the motor assembly 140 from being bumped by the shell 101 and thus damaged due to the vibration or the impact occurring during the transportation of the linear compressor 10. The stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

A spring coupling part 101*a* may be disposed on the inner circumferential surface of the shell 101. For example, the spring coupling part 101*a* may be disposed at a position that is adjacent to the second shell cover 103. The spring coupling part 101*a* may be coupled to a first support spring 166 of the first support device 165 that will be described later. Since the spring coupling part 101*a* and the first support device 165 are coupled to each other, the main body of the compressor may be stably supported inside the shell 101.

Figure 3:
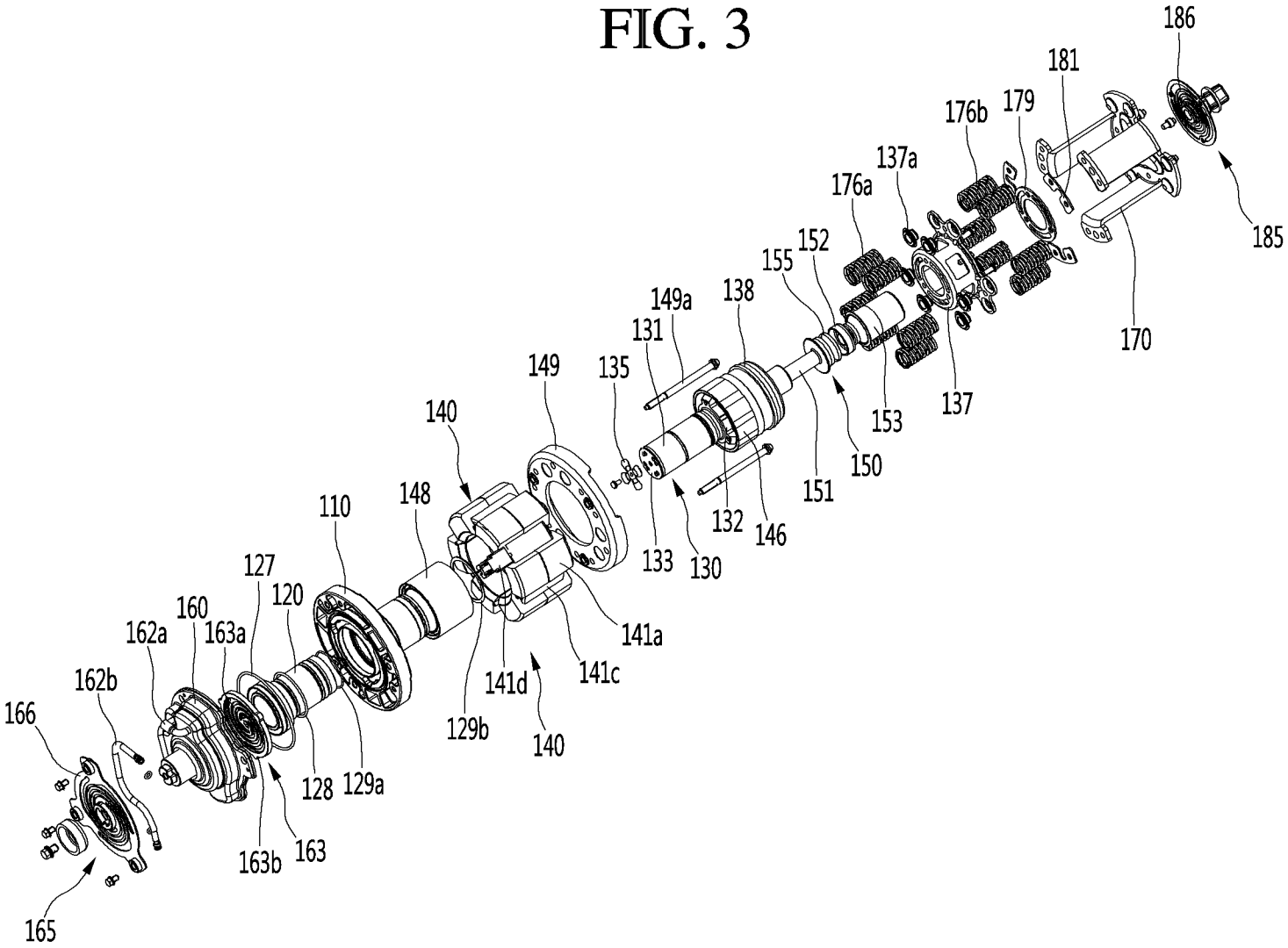
FIG. 3 is an exploded perspective view of a compressor main body accommodated in the shell of the linear compressor according to the first embodiment.
Figure 4:
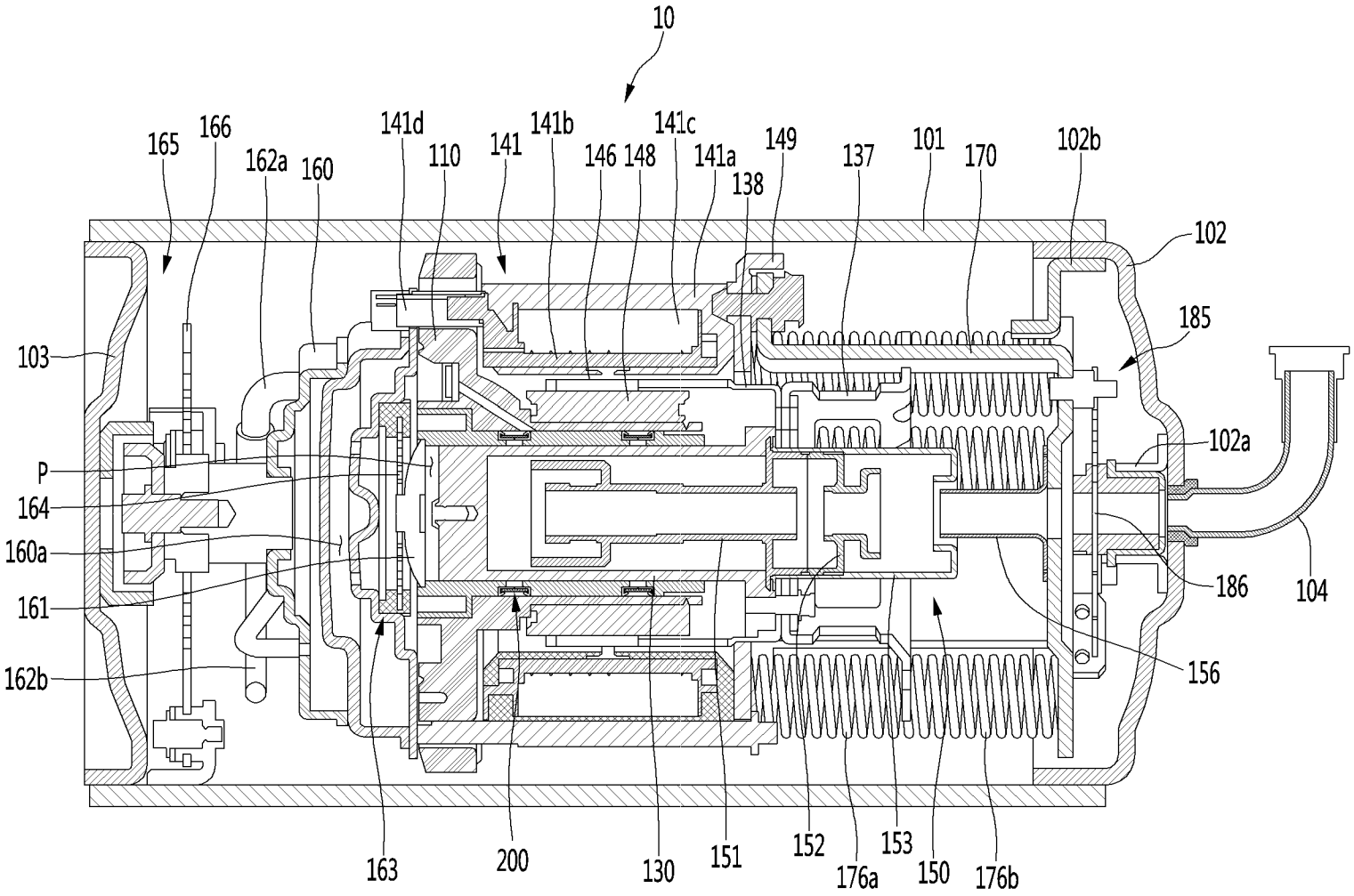
FIG. 4 is a cross-sectional view taken along line IV-IV' of FIG. 1.

FIG. 3 is an exploded perspective view of the compressor main body accommodated in the shell of the linear compressor according to the first embodiment, and FIG. 4 is a cross-sectional view taken along line IV-IV' of FIG. 1.

Referring to FIGS. 3 and 4, the linear compressor 10 according to an embodiment includes a cylinder 120 provided in the shell 101, a piston 130 that linearly reciprocates within the cylinder 120, and a motor assembly 140 that functions as a linear motor for applying driving force to the piston 130. When the motor assembly 140 is driven, the piston 130 may linearly reciprocate in the axial direction.

Also, the linear compressor 10 further include a suction muffler 150 coupled to the piston 130 to reduce a noise generated from the refrigerant suctioned through the suction pipe 104. The refrigerant suctioned through the suction pipe 104 flows into the piston 130 via the suction muffler 150. For example, while the refrigerant passes through the suction muffler 150, the flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153, which are coupled to each other.

The first muffler 151 is disposed within the piston 130, and the second muffler 152 is coupled to a rear side of the first muffler 151. Also, the third muffler 153 accommodates the second muffler 152 therein and extends to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 further includes a muffler filter 155. The muffler filter 155 may be disposed on an interface on which the first muffler 151 and the second muffler 152 are coupled to each other. For example, the muffler filter 155 may have a circular shape, and an outer circumferential portion of the muffler filter 155 may be supported between the first and second mufflers 151 and 152.

Hereinafter, the direction will be defined.

The "axial direction" may be understood as a direction in which the piston 130 reciprocates, i.e., the horizontal direction in FIG. 4. Also, in the axial direction", a direction from the suction pipe 104 toward a compression space P, i.e., a direction in which the refrigerant flows may be defined as a "front direction", and a direction opposite to the front direction may be defined as a "rear direction". When the piston 130 moves forward, the compression space P may be compressed.

On the other hand, the "radial direction" may be understood as a direction that is perpendicular to the direction in which the piston 130 reciprocates, i.e., the vertical direction in FIG. 4.

The piston 130 includes a piston body 131 having an approximately cylindrical shape and a piston flange 132 extending from the piston body 131 in the radial direction. The piston body 131 may reciprocate inside the cylinder 120, and the piston flange 132 may reciprocate outside the cylinder 120.

The cylinder 120 includes a cylinder body 121 extending in the axial direction and a cylinder flange 122 disposed outside a front portion of the cylinder body 121. Also, the cylinder 120 is configured to accommodate at least a portion of the first muffler 151 and at least a portion of the piston body 131.

The cylinder body 121 includes a gas inflow part 126 into which at least a portion of the refrigerant discharged through a discharge valve 161 that will be described later is introduced. The gas inflow part 126 passes inward from the outer circumferential surface of the cylinder body 121 in the radial direction.

The gas inflow part 126 may be provided in plurality. The plurality of gas inflow parts 126 may be disposed to be spaced apart from each other along the outer circumferential surface of the cylinder body 121 with respect to a central axis in the axial direction.

A filter assembly 200 is provided in the gas inflow part 126.

The filter assembly 200 includes a filter member for filtering foreign substances or oil components contained in the refrigerant gas. Also, the refrigerant passing through the filter member may be adjusted in flow rate through a nozzle provided in the filter assembly 200 to function as a gas bearing between the piston 130 and the cylinder 120.

Also, the cylinder 120 has a compression space P in which the refrigerant is compressed by the piston 130. Also, a suction hole 133 through which the refrigerant is introduced into the compression space P is defined in a front surface of the piston body 131, and a suction valve 135 for selectively opening the suction hole 133 is disposed on a front side of the suction hole 133.

Also, a coupling hole **136*a* to which a predetermined coupling member 136 is coupled is defined in a front surface of the piston body 131. In detail, the coupling hole 136*a* may be defined in a center of the front surface of the piston body 131, and a plurality of suction holes 133 are defined to surround the coupling hole 136*a*. Also, the coupling member 136 passes through the suction valve 135 and is coupled to the coupling hole 136*a* to fix the suction valve 135 to the front surface of the piston body 131**.

A discharge cover 160 defining a discharge space **160*a* for the refrigerant discharged from the compression space P and a discharge valve assembly 161 and 163 coupled to the discharge cover 160 to selectively discharge the refrigerant compressed in the compression space P are provided at a front side of the compression space P. The discharge space 160*a* includes a plurality of space parts that are partitioned by inner walls of the discharge cover 160**. The plurality of space parts are disposed in the front and rear direction to communicate with each other.

The discharge valve assemblies 161 and 163 include a discharge valve 161 that is opened when the pressure of the compression space P is above a discharge pressure to introduce the refrigerant into the discharge space **160*a* of the discharge cover 160 and a spring assembly 163 disposed between the discharge valve 161 and the discharge cover 160** to provide elastic force in the axial direction.

The spring assembly 163 includes a valve spring **163*a* and a spring support part 163*b* for supporting the valve spring 163*a* to the discharge cover 160. For example, the valve spring 163*a* may include a plate spring. Also, the spring support part 163*b* may be integrally injection-molded to the valve spring 163*a*** through an injection-molding process.

The discharge valve 161 is coupled to the valve spring **163*a*, and a rear portion or a rear surface of the discharge valve 161 is disposed to be supported on the front surface of the cylinder 120. When the discharge valve 161 is supported on the front surface of the cylinder 120, the compression space may be maintained in the sealed state. When the discharge valve 161 is spaced apart from the front surface of the cylinder 120**, the compression space P may be opened to allow the refrigerant in the compression space P to be discharged.

Thus, the compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

Also, when the pressure of the compression space P is above the discharge pressure, the valve spring 163*a* may be deformed forward to open the discharge valve 161. Here, the refrigerant may be discharged from the compression space P into the discharge space 160*a*. When the discharge of the refrigerant is completed, the valve spring 163*a* may provide restoring force to the discharge valve 161 to close the discharge valve 161.

The linear compressor 10 further includes a cover pipe 162*a* coupled to the discharge cover 160 to discharge the refrigerant flowing through the discharge space 160*a* of the discharge cover 160. For example, the cover pipe 162*a* may be made of a metal material.

Also, the linear compressor 10 further includes a loop pipe 162*b* coupled to the cover pipe 162*a* to transfer the refrigerant flowing through the cover pipe 162*a* to the discharge pipe 105. The cover pipe 162*a* may have one side of the loop pipe 162*b* coupled to the cover pipe 162*a* and the other side coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 further includes a frame 110. The frame 110 is understood as a component for fixing the cylinder 120. For example, the cylinder 120 may be press-fitted into the frame 110. Also, each of the cylinder 120 and the frame 110 may be made of aluminum or an aluminum alloy material.

The frame 110 includes a frame body 111 having an approximately cylindrical shape and a frame flange 112 extending from the frame body 111 in the radial direction. The frame body 111 is disposed to surround the cylinder 120. That is, the cylinder 120 may be disposed to be accommodated into the frame body 111. Also, the frame flange 112 may be coupled to the discharge cover 160.

Also, a gas hole 114 through which at least a portion of the refrigerant discharged through the discharge valve 161 flows to the gas inflow part 126 is defined in the frame 110. The gas hole 114 communicates with the frame flange 112 and the frame body 111.

The motor assembly 140 includes an outer stator 141, an inner stator 148 disposed to be spaced inward from the outer stator 141, and a magnet 146 disposed in a space between the outer stator 141 and the inner stator 148.

The magnet 146 may linearly reciprocate by a mutual electromagnetic force between the outer stator 141 and the inner stator 148. Also, the magnet 146 may be provided as a single magnet having one polarity or be provided by coupling a plurality of magnets having three polarities to each other.

The inner stator 148 is fixed to an outer circumference of the frame body 111. Also, in the inner stator 148, the plurality of laminations are laminated outside the frame body 111 in the radial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*.

The coil winding bodies 141*b*, 141*c*, and 141*d* further include a terminal part 141*d* that guides a power line connected to the coil 141*c* so that the power line is led out or exposed to the outside of the outer stator 141. The terminal part 141*d* extends to pass through the frame flange 112.

The stator core 141*a* includes a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. Here, the outer stator 141 may have one side supported by the frame flange 112 and the other side supported by the stator cover 149. In summary, the frame flange 112, the outer stator 141, and the stator cover 149 are sequentially disposed in the axial direction.

Also, the linear compressor 10 further includes a cover coupling member 149*a* for coupling the stator cover 149 to the frame flange 112. The cover coupling member 149*a* may pass through the stator cover 149 to extend forward to the frame flange 112 and then be coupled to the frame flange 112.

Also, the linear compressor 10 further includes a rear cover 170 coupled to the stator cover 149 to extend backward and supported by the second support device 185.

In detail, the rear cover 170 includes three support legs, and the three support legs may be coupled to a rear surface of the stator cover 149. A spacer 181 may be disposed between the three support legs and the rear surface of the stator cover 149. A distance from the stator cover 149 to a rear end of the rear cover 170 may be determined by adjusting a thickness of the spacer 181.

Also, the linear compressor 10 further includes an inflow guide part 156 coupled to the rear cover 170 to guide an inflow of the refrigerant into the suction muffler 150. At least a portion of the inflow guide part 156 may be inserted into the suction muffler 150.

Also, the linear compressor 10 further includes a plurality of resonant springs 176*a* and 176*b* that are adjusted in natural frequency to allow the piston 130 to perform a resonant motion. The driving part that reciprocates within the linear compressor 10 may stably move by the action of the plurality of resonant springs 176*a* and 176*b* to reduce the vibration or noise due to the movement of the driving part.

Also, the linear compressor 10 further includes a first support device 165 coupled to the discharge cover 160 to support one side of the main body of the compressor 10. The first support device 165 may be disposed adjacent to the second shell cover 103 to elastically support the main body of the compressor 10. In detail, the first support device 165 includes a first support spring 166. The first support spring 166 may be coupled to the spring coupling part 101*a*.

Also, the linear compressor 10 further includes a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

Also, the linear compressor 10 includes the frame 110 and a plurality of sealing members for increasing coupling force between the peripheral components around the frame 110. Each of the plurality of sealing members may have a ring shape.

In detail, the plurality of sealing members include a first sealing member 127 disposed at a portion at which the frame 110 and the discharge cover 160 are coupled to each other. Also, the plurality of sealing members further include second and third sealing members 128 and 129*a* provided to portions at which the frame 110 and the cylinder 120 are coupled to each other and a fourth sealing member 129*b* provided at a portion at which the frame 110 and the inner stator 148 are coupled to each other.

Hereinafter, the filter assembly according to embodiments will be described in detail with reference to the accompanying drawings.

Figure 5:
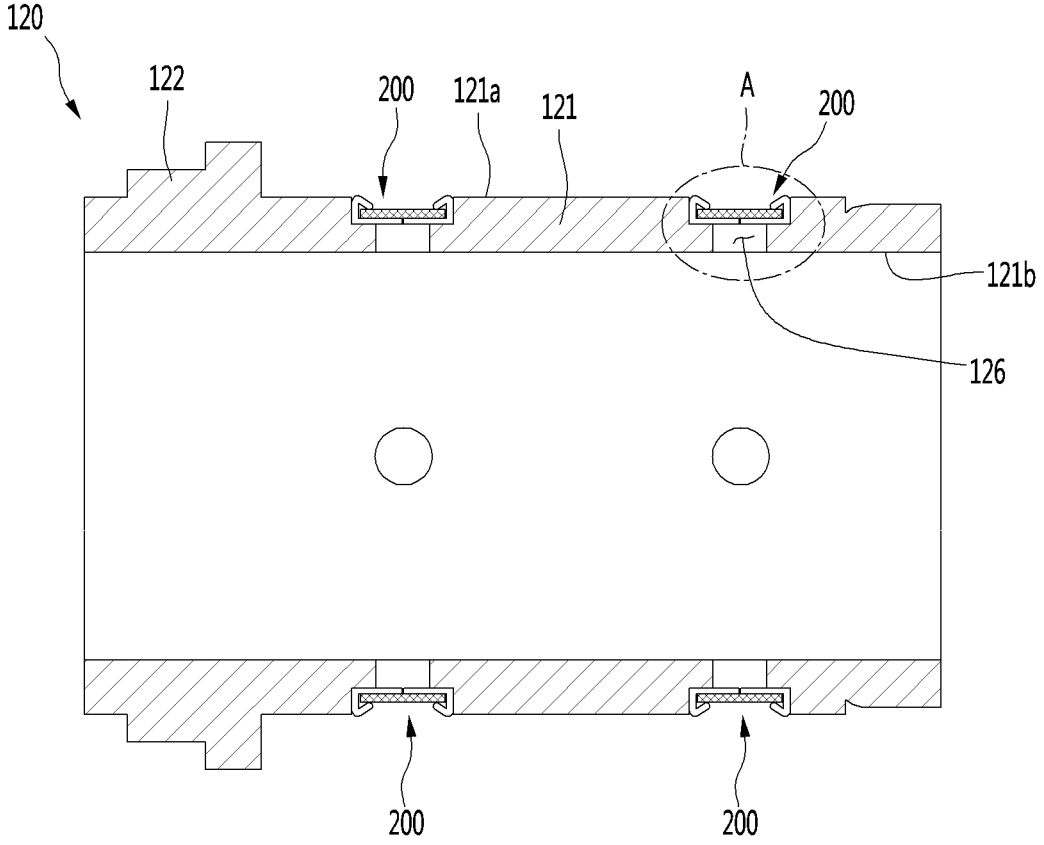
FIG. 5 is a view illustrating a state in which a filter assembly is provided in a cylinder according to the first embodiment.
Figure 6:
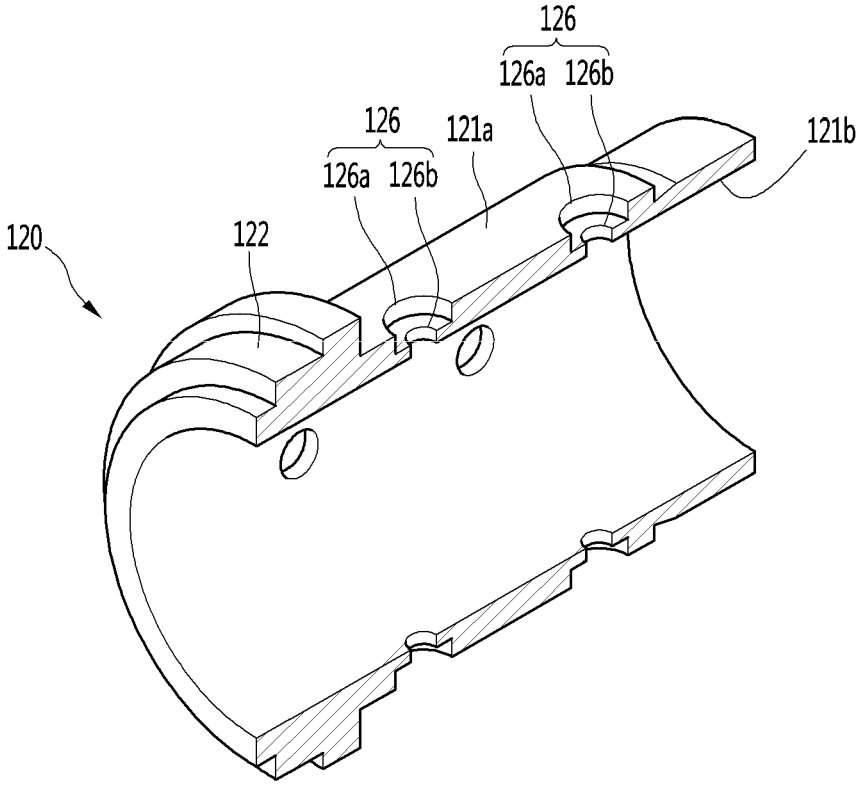
FIG. 6 is a view illustrating a configuration of the cylinder according to the first embodiment.
Figure 7:
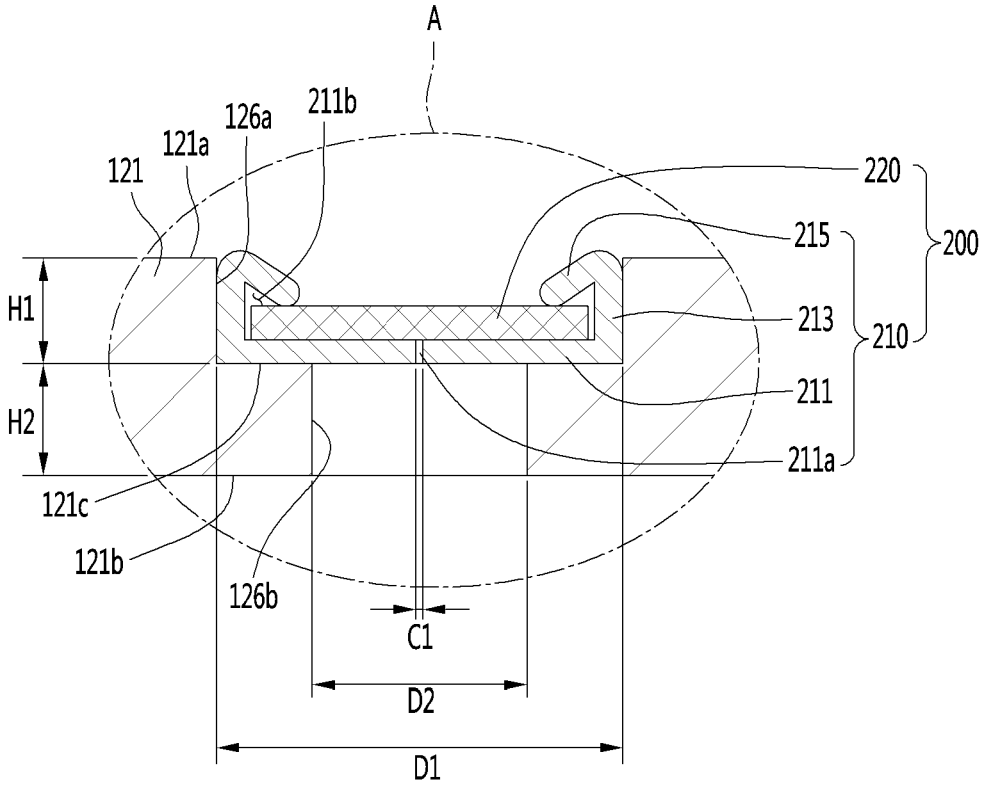
FIG. 7 is an enlarged view illustrating a portion A of FIG. 5.

FIG. 5 is a view illustrating a state in which the filter assembly is provided in a cylinder according to the first embodiment, FIG. 6 is a view illustrating a configuration of the cylinder according to the first embodiment, and FIG. 7 is an enlarged view illustrating a portion A of FIG. 5.

Referring to FIGS. 5 to 7, as described above, the cylinder 120 according to the first embodiment includes a cylinder body 121 and a cylinder flange 122 disposed outside a front portion of the cylinder body 121.

The cylinder body 121 may have a hollow cylindrical shape that lengthily extends in a horizontal direction or an axial direction. Also, the piston 130 is disposed in the cylinder body 121, and the frame 110 is disposed outside the cylinder body 121.

The cylinder 120 includes a gas inflow part 126 passing through the cylinder body 121. The gas inflow part 126 may be provided in plurality along a circumference of the cylinder body 121. The gas inflow part 126 is a space into which at least a portion of the refrigerant discharged through the discharge valve 161 is introduced into the cylinder body 121.

The gas inflow part 126 may pass inward from an outer circumferential surface 121*a* of the cylinder body 121 in the radial direction. That is, the gas inflow part 126 may be a portion that continuously passes from the outer circumferential surface 121*a* of the cylinder body 121 to an inner circumferential surface 121*b* of the cylinder body 121.

In detail, the gas inflow part 126 may include a seat groove 126*a* that is recessed inward from the outer circumferential surface 121*a* of the cylinder body 121 by a predetermined depth in the radial direction and a through-hole 126*b* passing from the seat groove 126*a* to the inner circumferential surface 121*b* of the cylinder body 121. That is, the seat groove 126*a* may communicate with the through-hole 126*b*. However, the seat groove 126*a* has a diameter D1 greater than that D2 of the through-hole 126*b*.

The seat groove 126*a* provides a space in which the filter assembly 200 is mounted. For this, the seat groove 126*a* is recessed from the outer circumferential surface 121*a* of the cylinder body 121 by a predetermined depth to define a seat surface 121*c* on which the filter assembly 200 is seated.

For example, the seat groove 126*a* may have a circular shape. In this case, a horizontal cross-section of the seat surface 121*c* may have a circular shape to support the filter assembly 200.

The through-hole 126*b* may be further recessed from the seat groove 126*a* by a predetermined depth to extend up to the inner circumferential surface 121*b* of the cylinder body 121. Particularly, the through-hole 126*b* passes from a central portion of the seat surface 121*c* to the inner circumferential surface 121*b* of the cylinder body 121.

Here, the through-hole 126*b* may have a diameter D2 less than that D1 of the seat groove 126*a* to provide the seat surface 121*c* on which the filter assembly 200 is seated.

For example, the through-hole 126*b* has the diameter D2 greater than a half of the diameter D1 of the seat groove 126*a*. Also, the through-hole 126*b* may have a recessed depth H2 equal to or different from that H1 of the seat groove 126*a*. For example, the seat groove 126*a* may have the recessed depth H1 less than or equal to that H2 of the through-hole 126*b*.

The through-hole 126*b* may have a circular shape. Thus, the refrigerant gas passing through the filter assembly 200 may be uniformly spread into the space between the piston 130 and the cylinder 120 through the through-hole 126*b*.

The gas inflow part 126 may be provided in plurality, which are spaced apart from each other along an outer surface of the cylinder 120. For example, the plurality of gas inflow parts 216 may be disposed to be spaced apart from each other along the outer circumferential surface 121*a* of the cylinder body 121 with respect to a central axis in the axial direction.

The plurality of gas inflow parts 216 may be disposed at a certain interval along the circumference of the cylinder 120. However, this embodiment is not limited thereto. For example, the gas inflow parts 216 may be variously designed in number and position.

The filter assembly 200 includes a filter bracket 210 seated in the seat groove 126*a* and a filter member 220 seated on the filter bracket 210. The filter bracket 210 allows the filter member 220 to be seated in the seat groove 126*a* and supports the filter member 220.

The filter bracket 210 may be molded through plastic injection molding. Also, the filter bracket 210 may have a circular shape.

In detail, the filter bracket 210 includes a plate 211 on which the filter member 220 is placed, an extension part 213 extending along an edge of the plate 211, and a bent part 215 bent inward from an end of the extension part 213.

The plate 211 may have a disc shape having a predetermined area. The plate 211 may have one surface contacting the filter member 220 and the other surface contacting the seat surface 121*c*. That is, in FIG. 7, the plate 211 may have a top surface on which the filter member 220 is placed and a bottom surface supported by the seat surface 121*c*.

Also, a hole is defined in the plate 211.

Here, the hole may include a nozzle 211*a* through which the refrigerant gas passes.

The nozzle 211*a* may be provided to pass through a predetermined point of the plate 211. Preferably, the nozzle 211*a* may pass through a central point of the top surface of the plate 211 in a downward direction.

For example, the nozzle 211*a* may have a circular horizontal cross-section. Also, the nozzle 211*a* may have a diameter C1 of about 20 μm to about 40 μm.

Also, a center of the nozzle 211*a* may coincide with that of the through-hole 126*b*. That is, since the nozzle 211*a* is disposed at a vertical center of the through hole 126*b*, an inner pressure of the through-hole 126*b* may be stably maintained, and the refrigerant introduced through the nozzle 211*a* may be uniformly spread into the space between the piston 130 and the cylinder 120.

The extension part 213 extends upward along an edge of the plate 211 to define an inner space 211*b* in which the filter member 220 is accommodated. That is, the extension part 213 may have a height higher than a thickness of the filter member 220 to surround the filter member 220.

Here, the filter bracket 210 may be made of a material different from that of the cylinder 120. That is, the filter bracket 210 may be made of a material having a thermal expansion coefficient different from that of the cylinder 120.

For example, the filter bracket 210 is made of a material having a thermal expansion coefficient less than that of the cylinder 120. When the filter bracket 210 is inserted into the seat groove 126*a*, an outer surface of the extension part 213 may be closely attached to an inner surface of the seat groove 126*a*.

That is, the filter bracket 210 may be made of a material having a thermal expansion coefficient less than that of the cylinder 120. Thus, the filter bracket 210 may be strongly closely attached to the gas inflow part 126 while receiving heat from the refrigerant discharged from the compression space P so as to be expanded. Thus, possibility of separation of the filter bracket 210 from the cylinder 120 may be reduced. For example, the filter bracket 210 may be made of high-temperature resistant engineering plastic, and the cylinder 120 may be made of an aluminum or metal material.

Also, an end of the extension part 213, i.e., a portion corresponding to an upper end of the extension part 213 may be bent inward to provide a bent part 215. That bent part 215 may be formed by pressing a portion of the extension part 213 in an inward direction of the filter bracket 210. Here, since an end of the bent part 215 strongly pushes a top surface of the filter member 220, the filter member 220 may be firmly fixed to the inside of the filter bracket 210.

The filter member 220 may be understood as a component that is mounted inside the filter bracket 210 to filter foreign substances contained in the refrigerant gas. The filter member 220 may be formed of a material having a magnetic property. Thus, the foreign substances contained in the refrigerant, particularly, metallic substances may be easily filtered.

The filter member 220 may be made of a metallic material. For example, the filter member 220 may be formed of stainless steel. Also, the filter member 220 may have a magnetic property and be prevented from being rusted. Also, the filter member 220 may be provided into a mesh type having a plurality of filter holes (not shown). For example, the filter hole may be designed to be a size of about 3 μm or less.

That is, the filter member 220 may have a disc-shaped outer appearance and be made of a porous metallic material. Thus, the filter performance of the filter member 220 may be deteriorated even though a pressure and temperature are sharply changed for a long time.

Figure 8:
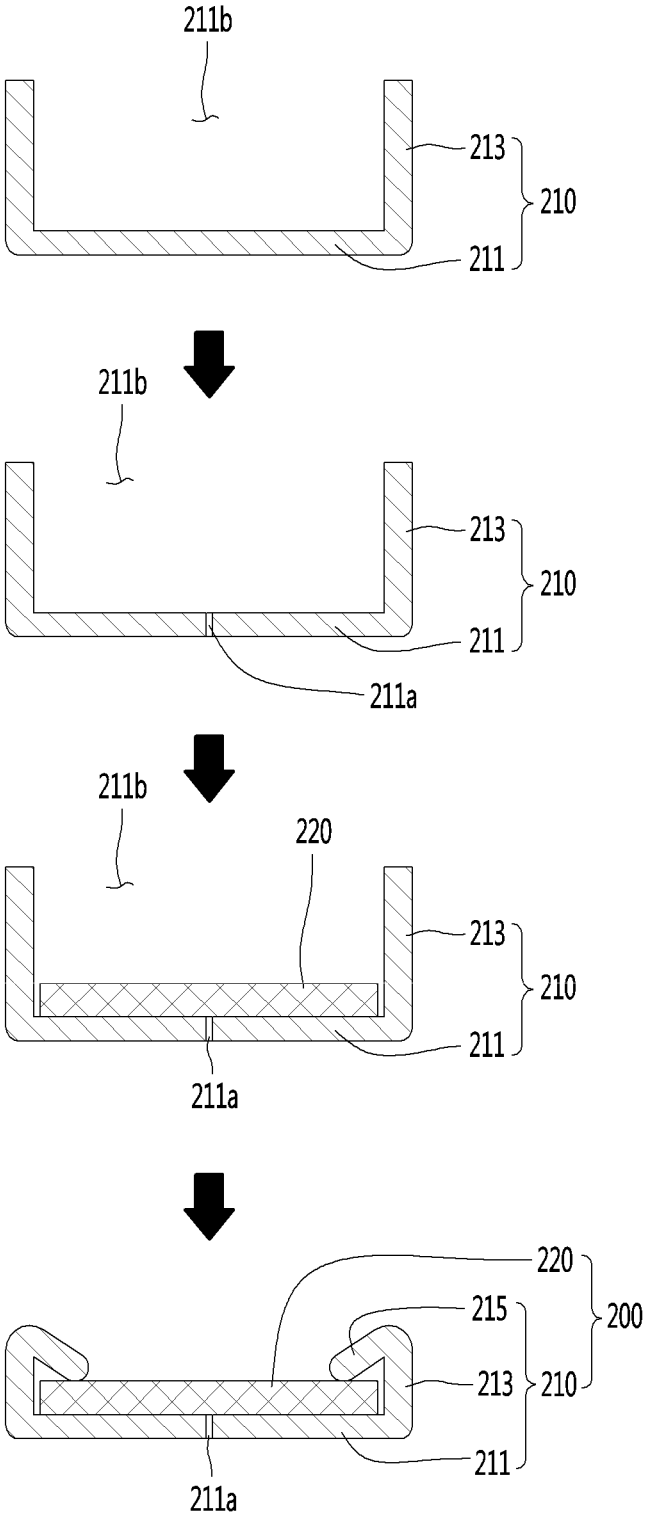
FIG. 8 is a view illustrating a method for manufacturing the filter assembly according to the first embodiment.

FIG. 8 is a view illustrating a method for manufacturing the filter assembly according to the first embodiment.

Referring to FIG. 8, a method for manufacturing a filter assembly 200 according to the first embodiment will be described in detail.

First, a filter bracket 210 is prepared.

For example, the filter bracket 210 may have a disc shape of which an upper portion is opened. That is, the filter bracket 210 may include a circular plate 211 and an extension part 213 extending upward along an edge of the plate 211. Thus, an inner space 211*b* having a cylindrical shape may be provided in the filter bracket 210. For example, the filter bracket 210 may be integrally molded through plastic injection molding.

Next, groove processing may be performed on the filter bracket 210.

That is, a punching process is performed on a central point of the plate 211 to form the nozzle 211*a*. Here, the punching is performed so that the nozzle 211*a* has a diameter of about 20 μm to about 40 μm.

Next, the filter member 220 is disposed inside the filter bracket 210.

That is, the filter member 220 made of a metallic material is seated inside the filter bracket 210.

Next, when the filter bracket 210 is seated on the filter member 220, an upper end of the filter bracket 210 may be pressed to be bent to the inside of the filter bracket 210. Thus, the upper end of the filter bracket 210 may be bent to be strongly closely attached to the upper portion of the filter member 220, thereby compressing and fixing the filter member 220.

As described above, when the filter member 220 is firmly fixed by the filter bracket 210, the filter bracket 210 is inserted into the seat groove 126*a*.

Thereafter, when the linear compressor 10 is driven, the filter bracket 210 may be strongly closely attached to the seat groove 126*a* while being expanded by receiving heat from the refrigerant discharged from the compression space P.

According to the above-described filter assembly, the filter and the filter bracket may be coupled through the sample process and easily installed on the outer surface of the cylinder. Thus, the filter assembly may be simplified, and the number of parts may be reduced to reduce product prices. In addition, when the filter needs to be replaced, since it is unnecessary to replace the entire filter, and only the filter which needs to be replaced is selectively replaced, repair and maintenance may be easy.

Figure 9:
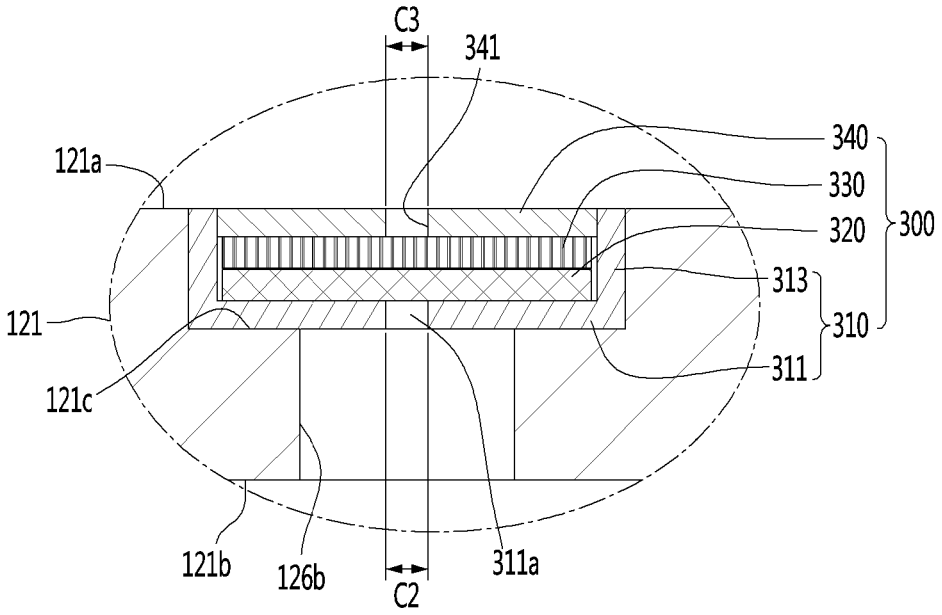
FIG. 9 is a view illustrating a state in which a filter assembly is provided in a cylinder according to a second embodiment.

FIG. 9 is a view illustrating a state in which a filter assembly is provided in a cylinder according to a second embodiment.

The current embodiment is the same as the first embodiment except for a structure of a filter assembly. Thus, only characterized parts of the current embodiment will be principally described below, and descriptions of the same part as that of the first embodiment will be quoted from the first embodiment.

Referring to FIG. 9, a filter assembly 300 according to a second embodiment is disposed in a gas inflow part 126 provided in an outer circumferential surface 121*a* of a cylinder 120. Particularly, the filter assembly 300 is inserted into a seat groove 126*a* of the gas inflow part 126.

The gas inflow part 126, i.e., constituents of the seat groove 126*a* and a through-hole 126*b* are the same as those of the first embodiment, and thus, their detailed descriptions will be omitted.

The filter assembly 300 includes a filter bracket 310 seated in the seat groove 126*a*, a filter support part 320 seated on the filter bracket 310, a filter member 330 disposed on the filter support part 320, and a bracket cover 340 covering an upper portion of the filter bracket 310.

The filter bracket 310 provides a space in which the filter support part 320 and the filter member 330 are accommodated. The filter bracket 310 may be molded through plastic injection molding. Also, the filter bracket 310 may have a circular shape on the whole.

In detail, the filter bracket 310 includes a plate 311 on which the filter support part 320 is placed and an extension part 313 extending along an edge of the plate 311.

The plate 311 may have a disc shape having a predetermined area. The plate 311 may have one surface contacting the filter support part 320 and the other surface contacting the seat surface 121*c*. That is, in FIG. 9, the plate 311 may have a top surface on which the filter support part 320 is placed and a bottom surface supported by the seat surface 121*c*.

Also, a hole 31*a* through which a refrigerant gas passes is defined in the plate 311.

The hole 311*a* may pass through a predetermined point of the plate 311. Preferably, the hole 311*a* may pass through a predetermined point of the top surface of the plate 311 in a downward direction.

For example, the hole 311*a* may have a circular horizontal cross-section. Also, the hole 311*a* may have a relatively large diameter C2. That is, the hole 311*a* may have a diameter C2 greater than that C1 of the above-described nozzle 211*a*.

Also, a center of the nozzle 211*a* may coincide with that of the through-hole 126*b*. That is, since the nozzle 211*a* is disposed at a vertical central line of the through hole 126*b*, an inner pressure of the through-hole 126*b* may be stably maintained, and the refrigerant introduced through the nozzle 211*a* may be uniformly spread into the space between the piston 130 and the cylinder 120.

The extension part 313 extends upward along an edge of the plate 311 to define an inner space 311*b* in which the filter support part 320 and the filter member 330 is accommodated. That is, the extension part 313 may extend by a length greater than the sum of a thickness of the filter support part 320 and a thickness of the filter member 330 to surround the filter support part 320 and the filter member 330.

Here, the filter bracket 310 may be made of a material having a thermal expansion coefficient less than that of the cylinder 120. Thus, when the filter bracket 310 is seated on the seat surface 121*c*, an outer surface of the extension part 313 may be closely attached to an inner surface of the seat groove 126*a*.

That is, the filter bracket 310 may be made of a material having a thermal expansion coefficient less than that of the cylinder 120. Thus, the filter bracket 310 may be strongly closely attached to the gas inflow part 126 while receiving heat from the refrigerant discharged from the compression space P so as to be expanded. Thus, possibility of separation of the filter bracket 310 from the cylinder 120 may be reduced. For example, the filter bracket 310 may be made of high-temperature resistant engineering plastic, and the cylinder 120 may be made of an aluminum or metal material.

The filter support part 320 may be understood as a constituent that is seated inside the filter bracket 310 to prevent the filter member 220 from being deformed. The filter support part 320 may be made of a porous metallic material. For example, the filter support part 320 may have a disc-shaped outer appearance and be made of a porous metallic material.

The filter member 330 may be understood as a constituent laminated on the filter support part 320 to filter foreign substances contained in the refrigerant gas while adjusting a flow rate of the refrigerant gas. The filter member 330 may be made of a porous organic material. For example, the filter member 330 may include a membrane filter made of a porous organic material. Thus, the foreign substances contained in the refrigerant gas may be filtered while passing through a plurality of filter holes defined in the filter member 330, and the refrigerant gas may be adjusted in flow rate.

The bracket cover 340 covers an opened top surface of the filter bracket 310 to fix the filter member 330. The bracket cover 340 may be made of the same material as the filter bracket 310. For example, the bracket cover 340 may be made of a plastic material. The bracket cover 340 may have a disc plate shape and seated on the filter member 330.

Also, in a state in which the bracket cover 340 contacts the top surface of the filter member 330, an outer circumferential surface of the bracket cover 340 may be fixed to an inner surface of the filter bracket 310. For example, in the state in which the bracket cover 340 contacts the top surface of the filter member 330, the filter member 330 may be thermally fused to the bracket cover 340 and thus fixed. Here, an outer surface of the bracket cover 340 may be smoothly connected to an outer circumferential surface 121*a* of the cylinder body 121 without having a stepped portion.

However, on the other hand, the bracket cover 340 may be disposed outside the filter bracket 310 but disposed inside the filter bracket 310. For example, the extension part 313 of the filter bracket 310 may extend by a length corresponding to an upper end of the filter member 330, and the bracket cover 340 may be disposed on an upper end of the extension part 313. In this case, in the state in which the bracket cover 340 contacts the top surface of the filter member 330, the bracket cover 340 may be thermally fused to the upper end of the extension part 313 and fixed. That is, the bracket cover 340 may cover the filter bracket 310 in various manners.

Also, a hole 341 through which the refrigerant gas passes is defined in the bracket cover 340.

The hole 341 may be defined in a predetermined point of the bracket cover 340 to pass through the bracket cover 340. Preferably, the hole 341 may pass through a central point of the top surface of the bracket cover 340 in a downward direction.

For example, the hole 341 may have a circular horizontal cross-section. Also, the hole 341 may have a relatively large diameter C3. The diameter C3 of the hole 341 of the bracket cover 340 may be equal to or different from that C2 of the hole 311*a* of the filter bracket 310. Also, the vertical center of the hole 342 of the bracket cover 340 may coincide with the vertical center of the hole 311 of the filter bracket 310.

Here, the hole 341 of the bracket cover 340 may be understood as an inlet hole through which the refrigerant is introduced, and the hole 311 of the filter bracket 310 may be understood as an outlet hole through which the refrigerant is discharged. That is, the refrigerant gas may be introduced into the inlet hole 341, and thus, the foreign substances may be filtered while the refrigerant gas passes through the filter member 330. Therefore, the refrigerant gas is adjusted in flow rate. Also, the refrigerant gas having a predetermined flow rate may pass through the outlet hole 311 and then be uniformly spread into a space between the piston 130 and the cylinder 120.

Figure 10:
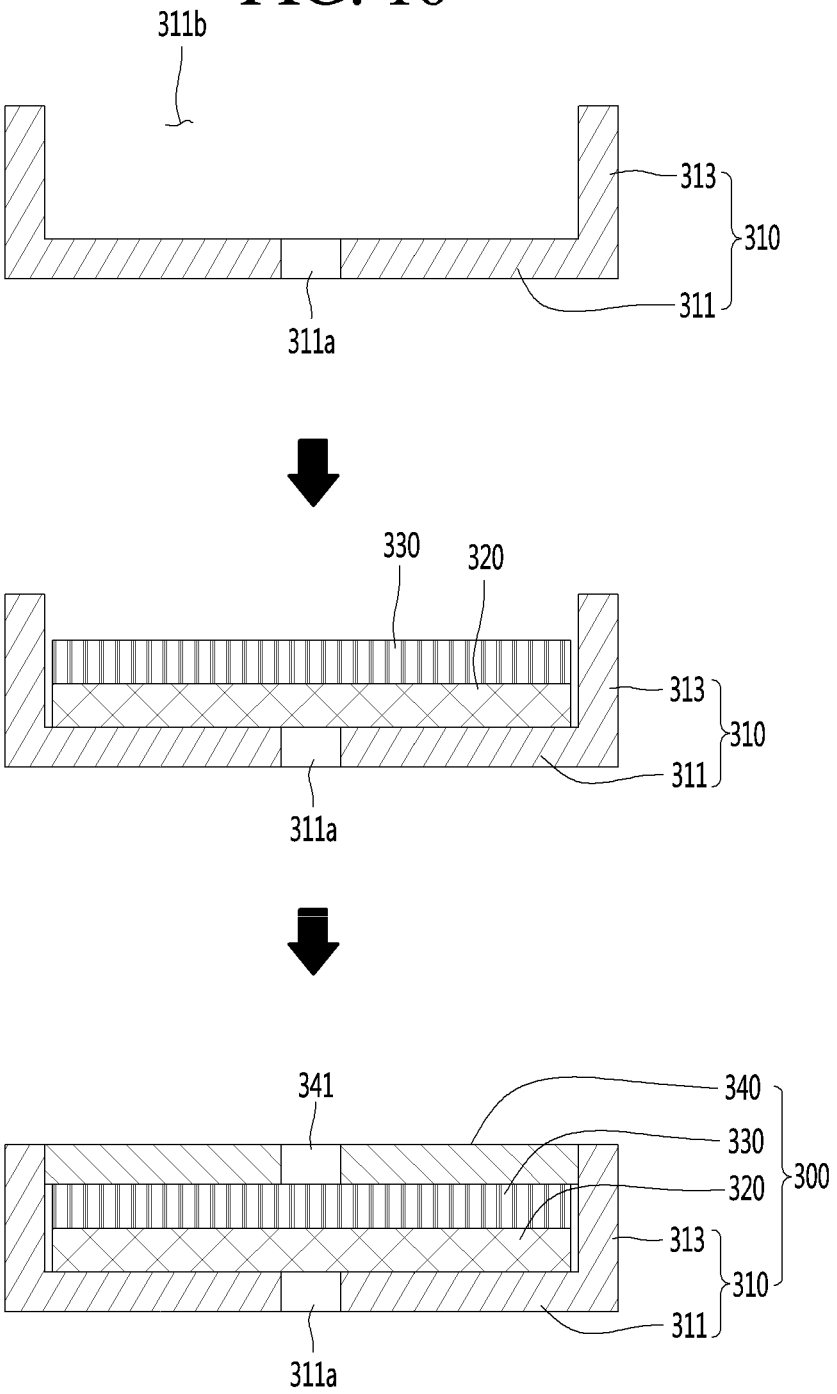
FIG. 10 is a view illustrating a method for manufacturing the filter assembly according to the second embodiment.

FIG. 10 is a view illustrating a method for manufacturing the filter assembly according to the second embodiment.

Referring to FIG. 10, a method for manufacturing a filter assembly 300 according to the second embodiment will be described in detail.

First, a filter bracket 310 is prepared.

For example, the filter bracket 310 may have a disc shape of which an upper portion is opened. That is, the filter bracket 310 may include a circular plate 311 and an extension part 313 extending upward along an edge of the plate 311. Thus, an inner space 311*b* having a cylindrical shape may be provided in the filter bracket 310. For example, the filter bracket 310 may be integrally molded through plastic injection molding.

Next, groove processing may be performed on the filter bracket 310.

That is, a punching process may be performed on a central point of the plate 311 to form the hole 311*a*.

Next, the filter support part 320 and the filter member 330 are sequentially laminated inside the filter bracket 310.

That is, the filter support part 320 made of the porous metallic material may be seated first inside the filter bracket 310, and the filter member 330 made of the porous organic material may be laminated on the filter support part 320.

Then, the bracket cover 340 covers the upper side of the filter member 330, and then, the bracket cover 340 fixes the filter bracket 310.

That is, in the state in which the bracket cover 340 contacts the top surface of the filter member 330, the bracket cover 340 may be thermally fused to the inner surface of the filter bracket 310. Thus, the opened top surface of the filter bracket 310 may be covered by the bracket cover 340, and the bracket cover 340 may be closely attached to the filter member 330 to strongly fix the filter member 330.

Figure 11:
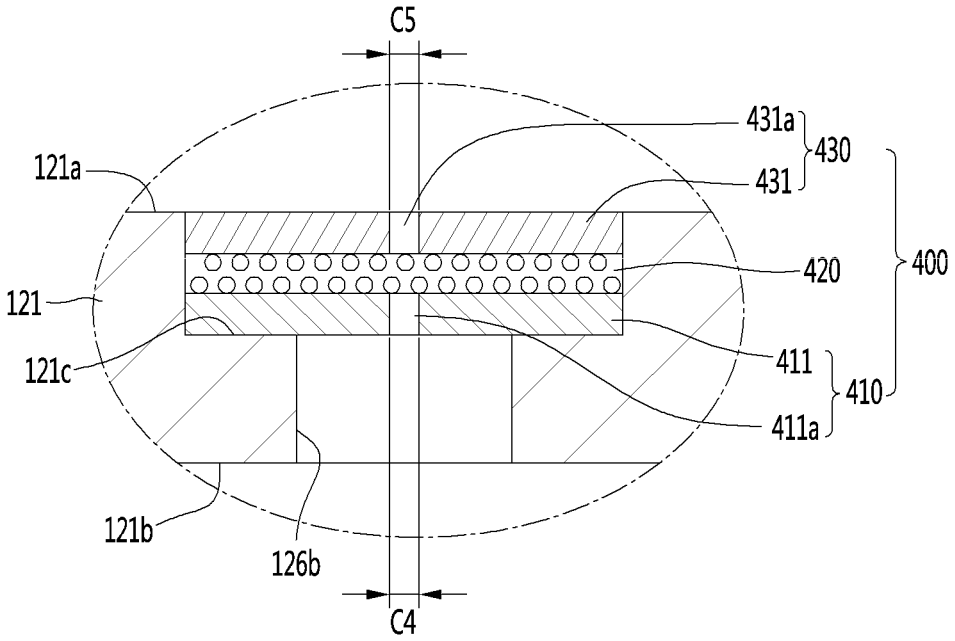
FIG. 11 is a view illustrating a state in which a filter assembly is provided in a cylinder according to a third embodiment.

FIG. 11 is a view illustrating a state in which a filter assembly is provided in a cylinder according to a third embodiment.

The current embodiment is the same as the first embodiment except for a structure of a filter assembly. Thus, only characterized parts of the current embodiment will be principally described below, and descriptions of the same part as that of the first embodiment will be quoted from the first embodiment.

Referring to FIG. 11, a filter assembly 400 according to a third embodiment is disposed in a gas inflow part 126 provided in an outer circumferential surface 121*a* of a cylinder 120. Particularly, the filter assembly 400 is inserted into a seat groove 126*a* of the gas inflow part 126.

The gas inflow part 126, i.e., constituents of the seat groove 126*a* and a through-hole 126*b* are the same as those of the first embodiment, and thus, their detailed descriptions will be omitted.

The filter assembly 400 includes a first plate 410 seated in the seat groove 126*a*, a filter member 420 disposed on the first plate 410, and a second plate 430 disposed on the filter member 420.

Here, the first plate 410, the filter member 420, and the second plate 430 may be sequentially laminated. That is, the filter member 420 may be disposed between the first plate 410 and the second plate 430 and thus closely attached to be supported.

The first plate 410 has a disc shape and is disposed at the innermost side of the seat groove 126*a*. The first plate 410 may be molded through plastic injection molding.

Also, a hole through which a refrigerant gas passes may be defined in the first plate 410. Here, the hole may include a nozzle 411*a*. The nozzle 411*a* may be provided to pass through a predetermined point of the first plate 411. Preferably, the nozzle 411*a* may pass through a central point of the top surface of the first plate 411 in a downward direction.

For example, the nozzle 411*a* may have a circular horizontal cross-section. Also, the nozzle 411*a* may have a relatively large diameter C4. That is, the nozzle 411*a* may have a diameter C4 greater than that C1 of the nozzle 211*a* described according to the first embodiment.

This is done because the diameter C4 of the nozzle 411*a* does not need to be very small because the filter member 420 adjusts a flow rate of the refrigerant gas.

That is, in this embodiment, since the filter member 420 adjusts the flow rate of the refrigerant gas, the diameter C4 of the nozzle 411*a* may be significantly reduced when compared to that of the existing nozzle. Also, since the nozzle 411*a* has the relatively large diameter C4, possibility of blocking of the nozzle 411*a* due to foreign substances may be significantly reduced.

Also, a center of the nozzle 411*a* may coincide with that of the through-hole 126*b*. That is, the nozzle 411*a* may be disposed in a vertical central line of the through-hole 126*b*.

The filter member 420 may be understood as a constituent laminated on the first plate 410 to filter the foreign substances contained in the refrigerant gas while adjusting the flow rate of the refrigerant gas. The filter member 420 may be made of a porous organic or metallic material. For example, the filter member 420 may include a membrane filter. Thus, the foreign substances contained in the refrigerant gas may be filtered while passing through a plurality of filter holes defined in the filter member 420, and the refrigerant gas may be adjusted in flow rate.

The second plate 430 is laminated on the first plate 410 and disposed at the outermost side of the seat groove 126*a*. The second plate 430 may have a shape corresponding to that of the first plate 410. That is, the second plate 430 may be molded in a disc shape through plastic injection molding.

Also, a hole through which a refrigerant gas passes may be defined in the second plate 430. Here, the hole may include a nozzle 431*a*. The nozzle 431*a* may be provided to pass through a predetermined point of the second plate 441. Preferably, the nozzle 431*a* may pass through a central point of the top surface of the second plate 431 in a downward direction.

For example, the nozzle 431*a* may have a circular horizontal cross-section. The nozzle 431*a* of the second plate 431 may have a diameter C5 that is the same as a diameter C4 of the nozzle 411*a* of the first plate 411. Also, the nozzle 431*a* of the second plate 431 may have the same vertical central line as the nozzle 411*a* of the first plate 411. That is, the two nozzles may be disposed to face each other with respect to the filter member 420.

Here, the nozzle 431*a* of the second plate 431 may be understood as an inflow nozzle through which the refrigerant is introduced, and the nozzle 411*a* of the first plate 411 may be understood as a discharge nozzle through which the refrigerant is discharged. That is, the refrigerant gas may be introduced into the inflow nozzle 431*a*, and thus, the foreign substances may be filtered while the refrigerant gas passes through the filter member 420. Therefore, the refrigerant gas is adjusted in flow rate. Also, the refrigerant gas having a predetermined flow rate may pass through the discharge nozzle 411*a* and then be uniformly spread into a space between the piston 130 and the cylinder 120.

In this embodiment, since the filter member 420 performs the function of filtering the foreign substances contained in the refrigerant gas while adjusting the flow rate of the refrigerant gas, the nozzles 411*a* and 431*a* may be designed so that each of their diameters C4 and C5 is greater than that of the existing nozzle. Thus, the nozzles 411*a* and 431*a* may have the relatively large diameters C4 and C5 to significantly prevent the nozzles from being blocked by oil or foreign substances.

Also, the filter member 420 may be deformed by sharp pressure and temperature changes. However, the first plate 410 and the second plate 430 may vertically support the filter member 420 to minimize the occurrence of the deformation of the filter member 420.

Although the first plate 410 and the second plate 430 vertically support the filter member 420 in this embodiment, one of the first plate 410 and the second plate 430 may be omitted. For example, when the second plate is omitted, the foreign substances contained in the refrigerant gas may be filtered, and also, the refrigerant gas may be adjusted in flow rate while the refrigerant gas passes through the filter member 420. Also, the refrigerant gas having a predetermined flow rate may pass through the discharge nozzle 411*a* and then be uniformly spread into a space between the piston 130 and the cylinder 120.

Figure 12:
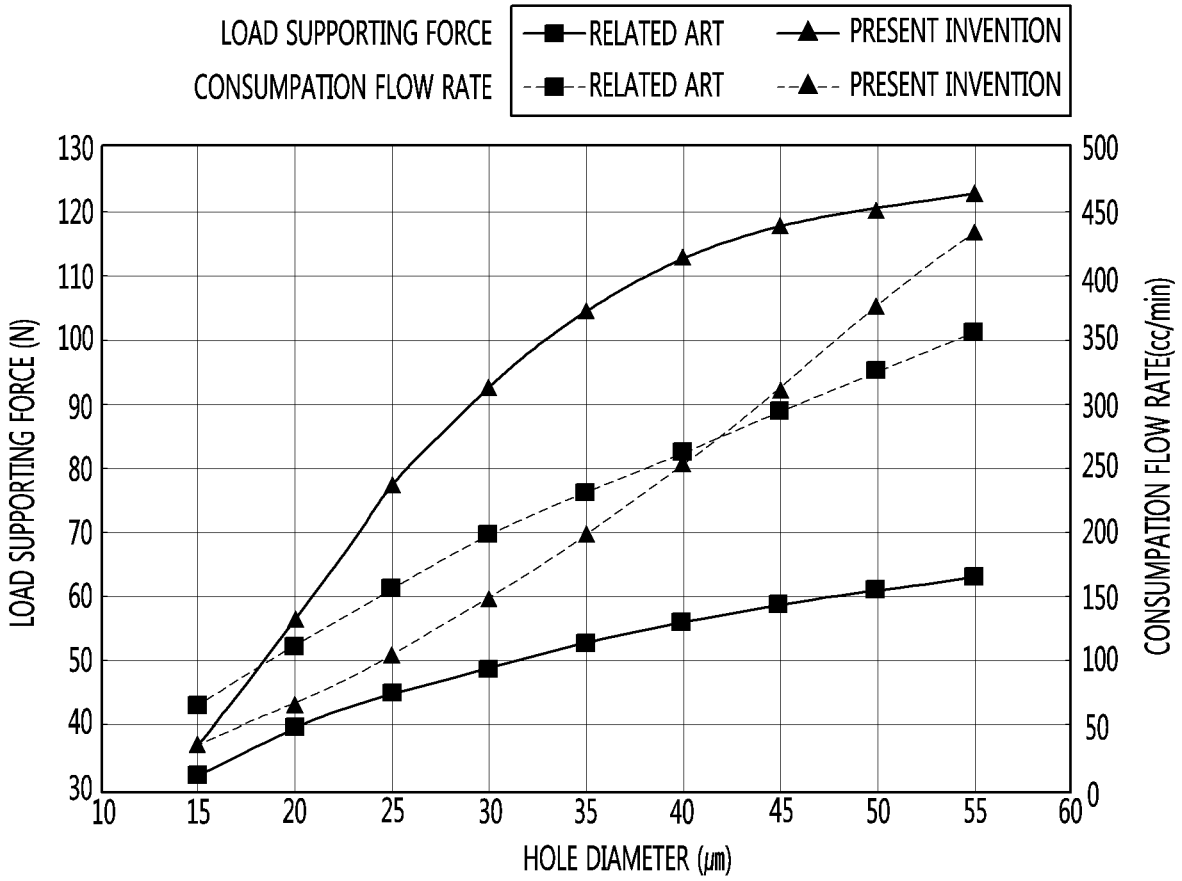
FIG. 12 is a graph illustrating a performance effect of a gas bearing of the compressor according to the first embodiment.

FIG. 12 is a graph illustrating a performance effect of the gas bearing of the compressor according to the first embodiment.

Referring to FIG. 12, a horizontal axis of the graph represents a diameter (μm) of the nozzle provided in the outer circumferential surface of the cylinder, a vertical left axis represents a load supporting force (N) that means floating force of the gas bearing, and a vertical right axis represents a consumption flow rate (cc/min) of the gas bearing.

Particularly, as illustrated in FIG. 12, in a section in which the nozzle has a diameter of about 20 μm to about 40 μm, in case of the related art, the consumption flow rate is about 52 cc/min to about 82 cc/min, and in case of an embodiment, the consumption flow rate is about 43 cc/min to about 80 cc/min.

Also, in a section in which the nozzle has a diameter of about 20 μm to about 40 μm, in case of the related art, the load supporting force is about 40 N to about 56 N, and in case of an embodiment, the load supporting force is about 56 N to about 113 N.

That is, in the section in which the nozzle has a diameter of about 20 μm to about 40 μm, it is seen that an amount of refrigerant gas used for the gas bearing is relatively small, but the load supporting force largely increases when compared to those of the refrigerant gas according to the related art.

Thus, according to the embodiment, although the consumption flow rate of the refrigerant gas is relatively smaller than that of the refrigerant gas according to the related art, the piston supporting force equal to or greater than that according to the related art may be secured.

The linear compressor including the above-described constituents according to the embodiment may have the following effects.

First, since the filter bracket having the hole is provided in the gas inflow part passing through the cylinder, and the filter member for filtering the foreign substances contained in the refrigerant gas is provided in the filter bracket, the flow rate of the refrigerant gas used as the gas bearing may be adjusted, and also, the foreign substance contained in the refrigerant gas may be filtered. Thus, although the nozzle through which the refrigerant gas is introduced into the cylinder is minimized in diameter or number, the blocking of the nozzle may be prevented while maintaining the performance of the gas bearing. Thus, although the consumption flow rate of the refrigerant gas is relatively smaller than that of the refrigerant gas according to the related art, the piston supporting force equal to or greater than that according to the related art may be secured.

Second, since the filter bracket is inserted into the seat groove that is recessed inward from the outer circumferential surface of the cylinder in the radial direction, and the filter member is laminated on the filter bracket, the filter assembly may be easily installed, and the separation of the filter assembly from the cylinder may be prevented.

Third, since the filter bracket is provided to surround the filter member, when the vibration or shaking occurs, the filter member may be safely protected, and the separation of the filter member from the filter bracket may be prevented.

Fourth, since the bracket cover covering the opened surface of the filter bracket and presses the filter member may be further provided to firmly support the filter member and prevent the filter member from being separated from the filter bracket.

Fifth, the filter member may be made of the metallic material having the plurality of filter holes to prevent the pressure and the temperature from being sharply changed and prevent the filtering performance from being reduced.

Sixth, when the filter member is made of the porous organic material, the filter support part for holding the filter member may be further provided in the filter bracket to prevent the filter member from being deformed and separated.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:
- a shell that defines an outer appearance of the linear compressor;
- a cylinder that is disposed in the shell and that defines a compression space configured to receive refrigerant therein;
- a piston disposed in the cylinder and configured to reciprocate relative to the cylinder;
- a motor assembly that is configured to move the piston in an axial direction of the cylinder and that is configured to, based on movement of the piston in the axial direction of the cylinder, cause compression of the refrigerant received in the compression space;
- a gas inflow part that is defined at the cylinder and that passes through at least a portion of the cylinder; and
- a filter assembly disposed at the gas inflow part, the filter assembly comprising:
  - a filter bracket that defines a bracket hole and that is disposed at the gas inflow part, and
  - a filter member disposed on the filter bracket, the filter member being disposed outside the bracket hole, wherein the gas inflow part comprises:
- a seat groove recessed radially inward from an outer circumferential surface of the cylinder toward the compression space, and that provides a space in which the filter bracket is seated, and
- a through-hole that extends from the seat groove to an inner circumferential surface of the cylinder, and wherein a diameter of the through-hole is less than a diameter of the seat groove and greater than the diameter of the bracket hole.

2. The linear compressor according to claim 1, wherein the filter bracket surrounds the filter member.

3. The linear compressor according to claim 1, wherein the filter bracket comprises:

a plate that defines the bracket hole and that is disposed on the seat groove; and an extension part that extends from an edge of the plate toward the outer circumferential surface of the cylinder, and wherein the plate and the extension part define an accommodation space that receives the filter member.

4. The linear compressor according to claim 3, wherein the filter member comprises one or more layers that are disposed on the plate of the filter bracket in the accommodation space.

5. The linear compressor according to claim 3, wherein the filter member is configured to receive a portion of refrigerant discharged from the compression space and to allow the portion of refrigerant to pass through the bracket hole of the filter bracket and the through-hole of the gas inflow part.

6. The linear compressor according to claim 3, wherein a recessed depth of the seat groove from the outer circumferential surface of the cylinder is less than or equal to a length of the through-hole from the seat groove to the inner circumferential surface of the cylinder.

7. The linear compressor according to claim 3, wherein the filter member is made of a metallic material and has a plurality of filter holes, and wherein the filter bracket is made of a plastic material.

8. The linear compressor according to claim 3, wherein the filter bracket further comprises a bent part that is bent from a portion of the extension part toward the accommodation space, and wherein at least a portion of the bent part contacts the filter member.

9. The linear compressor according to claim 3, wherein the filter assembly further comprises a filter support part that is disposed in the accommodation space at a position between the plate of the filter bracket and the filter member.

10. The linear compressor according to claim 9, wherein the filter member is made of a porous organic material, and wherein the filter support part is made of a porous metallic material.

11. The linear compressor according to claim 9, wherein the extension part of the filter bracket defines an open surface of the filter bracket, and wherein the filter assembly further comprises a bracket cover that covers the open surface of the filter bracket.

12. The linear compressor according to claim 11, wherein the bracket cover is disposed on the filter member and defines a cover hole.

13. The linear compressor according to claim 12, wherein a diameter of the cover hole is greater than or equal to a diameter of the bracket hole.

14. The linear compressor according to claim 12, wherein the cover hole and the bracket hole are coaxial and extend toward the compression space.

15. The linear compressor according to claim 8, wherein an end of the bent part is disposed radially inward of the outer circumferential surface of the cylinder, and wherein the end of the bent part contacts an outer surface of the filter member.

16. The linear compressor according to claim 1, wherein a lower surface of the filter bracket contacts and supports a bottom surface of the filter member.

17. The linear compressor according to claim 1, wherein an upper end of the filter bracket is bent downward to the filter member, the filter bracket defining an opening of the seat groove above a center portion of the filter member, and an inner space above an edge of the filter member.

18. A linear compressor comprising:

a shell that defines an outer appearance of the linear compressor;

a cylinder that is disposed in the shell and that defines a compression space configured to receive refrigerant therein;

a piston disposed in the cylinder and configured to reciprocate relative to the cylinder;

a motor assembly that is configured to move the piston in an axial direction of the cylinder and that is configured to, based on movement of the piston in the axial direction of the cylinder, cause compression of the refrigerant received in the compression space;

a gas inflow part that is defined at the cylinder and that passes through at least a portion of the cylinder; and a filter assembly disposed at the gas inflow part, wherein the gas inflow part comprises:

a seat groove recessed radially inward from an outer circumferential surface of the cylinder toward the compression space, and that provides a space in which the filter assembly is seated, and a through-hole that extends from the seat groove to an inner circumferential surface of the cylinder, wherein the filter assembly comprises:

a first plate that defines a first hole and that is disposed on the seat groove, a filter member disposed on the first plate, the filter member being disposed outside the first hole, and a second plate that defines a second hole and that is disposed on the filter member, and wherein a diameter of the seat groove is greater than a diameter of the through-hole of the gas inflow part, and a diameter of the first hole of the first plate is less than the diameter of the through-hole.

19. The linear compressor according to claim 18, wherein the diameter of the first hole is equal to a diameter of the second hole.

20. The linear compressor according to claim 18, wherein the first hole and the second hole are coaxial and extend toward the compression space.

* * * * *